United States Patent [19]

Allen

[11] Patent Number: 4,836,702

[45] Date of Patent: Jun. 6, 1989

[54] CLEANING DEVICE FOR PAINT BRUSHES AND ROLLERS

[75] Inventor: Donavan J. Allen, Taylors, S.C.

[73] Assignee: Torus Corporation, Greenville, S.C.

[21] Appl. No.: 124,051

[22] Filed: Nov. 23, 1987

[51] Int. Cl.[4] ..... B08B 3/02

[52] U.S. Cl. ..... 401/10; 401/9; 401/139; 239/562; 239/567; 239/543; 15/104.04; 15/104.92

[58] Field of Search ..... 15/104.04, 104.92; 401/139, 122, 261, 265, 266, 9, 10; 134/138, 199; 68/213; 239/543, 562, 567

[56] References Cited

U.S. PATENT DOCUMENTS

| | | | |
|---|---|---|---|
| 648,263 | 4/1900 | Hull | 239/567 X |
| 1,284,139 | 11/1918 | Ponic | 134/199 |
| 1,829,831 | 11/1931 | Hiskey | 134/199 X |
| 1,948,807 | 2/1934 | Taylor | 239/543 |
| 2,456,703 | 12/1948 | Hatchette | 239/562 |
| 2,824,323 | 2/1958 | Tos et al. | 15/104.04 X |
| 2,985,178 | 5/1961 | Cristensen, Jr. | 401/10 |
| 3,568,934 | 3/1971 | Dunn | 239/567 |
| 3,721,252 | 3/1973 | Ayella | 134/199 X |
| 3,731,697 | 5/1973 | Yost | 134/138 |
| 4,324,018 | 4/1982 | Olsson | 15/104.04 X |
| 4,508,465 | 4/1985 | Orton | 401/137 |
| 4,509,545 | 4/1985 | Trotter | 134/199 |
| 4,709,717 | 12/1987 | Rannigan et al. | 134/199 |

*Primary Examiner*—Richard J. Apley
*Assistant Examiner*—Franklin L. Gubernick
*Attorney, Agent, or Firm*—Bailey & Hardaway

[57] ABSTRACT

A cleaning device for paint brushes and rollers which employs a scrubbing action for lifting and separating bristles or mat for optimal cleaning and which allows the progress of the cleaning process to be continuously and conveniently monitored. The device comprises an annular spray ring having an exterior radially directed flange and a plurality of spray ports on the inside surface of the ring. The ports are aimed so that the individual water streams converge at a point exterior to the plane of the ring.

4 Claims, 2 Drawing Sheets

CLEANING DEVICE FOR PAINT BRUSHES AND ROLLERS

BACKGROUND OF THE INVENTION

This invention relates generally to the art of cleaning devices and, more particularly, to the art of devices for cleaning paint applicators.

There is widespread use of paint brushes and paint rollers for applying paint to surfaces. Through use, however, the brush or roller becomes totally saturated and paint is forced deep within bristles to become trapped at the handle, or penetrates the roller mat to remain at its core. Current methods of cleaning, to a greater or lesser extent, allow residue to remain in the applicator. When dry, the residual paint and/or other deposits inhibit effective use of the brush or roller and cause the item to be untimely discarded. With effective cleaning, however, the life of the applicator may be significantly extended.

Complicating the cleaning process is the consideration that rollers vary in diameter, and a cleaning apparatus having an interference fit with one roller may not suitably engage another roller. Additionally, liquid under pressure must be applied at an appropriate angle to the roller to avoid causing the mat of the roller to compress, in hibiting penetration of the liquid into the mat. Further, the inevitable splashing caused by liquid under pressure must be offset. However, to shield the user inevitably inhibits the user's ability to monitor the cleaning process. Periodically, then, the process must be interrupted so that the user can evaluate progress which causes inconvenience and takes additional time.

Various cleaning devices for paint applications and methods for their use have existed within the prior art. U.S. Pat. No. 4,606,777 to Brow discloses an apparatus for cleaning a paint roller comprising an annular sleeve adapted to have an interference fit with the pad of the roller. A similar device is disclosed in U.S. Pat. No. 4,517,699 to Petricks which further includes scrubber elements positioned along the inner surface of the annular sleeve.

In U.S. Pat. No. 4,126,484 to Monteiro, an elongated, hollow cylindrical body is disclosed which slidability receives the roller in close tolerance. Cylindrical casings for roller-type applicators are also disclosed in U.S. Pat. No. 4,377,175 to Fritz and U.S. Pat. No. 4,155,230 to Lacher. U.S. Pat. No. 2,985,178 to Christensen provides an annular tube with orifices which are tangentially directed against the surface of a roller, causing it to spin or rotate. An axially extending shield arranged about the annular tube to protect the user is included in the disclosure. Other related disclosures include U.S. Pat. No. 3,577,280 to George and U.S. Pat. No. 3,421,527 to Dettman.

Thus, while many devices exist for cleaning roller-type paint applicators, there remains a need to provide a device for cleaning paint applicators in general, and one which allows the cleaning process to be monitored while in progress rather than hidden from view by a protective shield.

SUMMARY OF THE INVENTION

It is thus an object of this invention to provide a novel apparatus for cleaning paint brushes and rollers in an efficient and thorough manner so as to substantially extend the life and performance of the brush or roller.

It is a further object of this invention to provide a novel apparatus for cleaning paint brushes and rollers which allows the progress of the cleaning process to be continuously and conveniently monitored.

It is still a further object of this invention to provide a novel process for cleaning paint brushes and rollers which employs a scrubbing action for optimal cleaning.

These, as well as other objects, are accomplished by a cleaning device for paint brushes and rollers comprising an annular sleeve, having an outer surface and an inner surface, defining an annular liquid passage means within the sleeve between its inner and outer surfaces, a longitudinal sleeve defining a liquid entry means for connecting to the liquid passage means, including a threaded connection for accepting a conventional hose fitting for connecting the liquid passage means with a source of liquid under pressure and a ball valve for regulating the flow of the liquid, liquid outlet means which communicates with the liquid passage means and is disposed in a circle about the inner surface of the annular sleeve, and an external flange disposed circumferentially around the outer surface of the annular sleeve including means for scraping and loosening paint or other deposits from the paint brush or roller.

DETAILED DESCRIPTION OF THE DRAWINGS

In accordance with this invention, it has been found that a cleaning device described herein efficiently and thoroughly cleans paint brushes and rollers, significantly extending the life and performance of both items. The circular configuration of the liquid outlet means or ports, together with the specific angle at which the ports are disposed, definces an inverted conical zone of optimal cleaning and minimal splashing. The design of the ports increases the velocity of the liquid as it exits the cleaning device producing a plurality of jet streams which, within this zone, lift, separate and otherwise manipulate the contacted material, providing a scrubbing action to accomplish thorough cleaning. This scrubbing action cleans below surfaces allowing the liquid to penetrate the brush bristles to their origin at the handle and the roller mat to its core for deep-cleaning results. Penetration is further enhanced by the size and design of the ports. If ports are too small, insufficient liquid is provided for adequate agitation or for washing away loosened paint or other deposits. If ports are too large, the surface of bristles or mat tends to compress, causing a barrier to liquid entry, and the penetrating effect is lost.

In addition, the blade and notches provided on the cleaning device serve to loosen even hardened paint from brush or roller.

For optimal cleaning, the paint brush or roller is positioned within the stated zone and is moved axially with short back and forth motions. Due to the design of the preferred embodiment of the device of the instant invention, the cleaning process is effectively and conveniently monitored as it proceeds. Areas of the brush or roller needing further attention are readily identified and the overall process is rapidly expedited. Use of the device of the instant invention provides an easy and quick way to clean paint brushes and rollers, reducing the mess and frustration typically associated with this task. These, as well as other advantages and features, will be apparent from the following description and referrence to the Figures of drawing.

Figure 1:
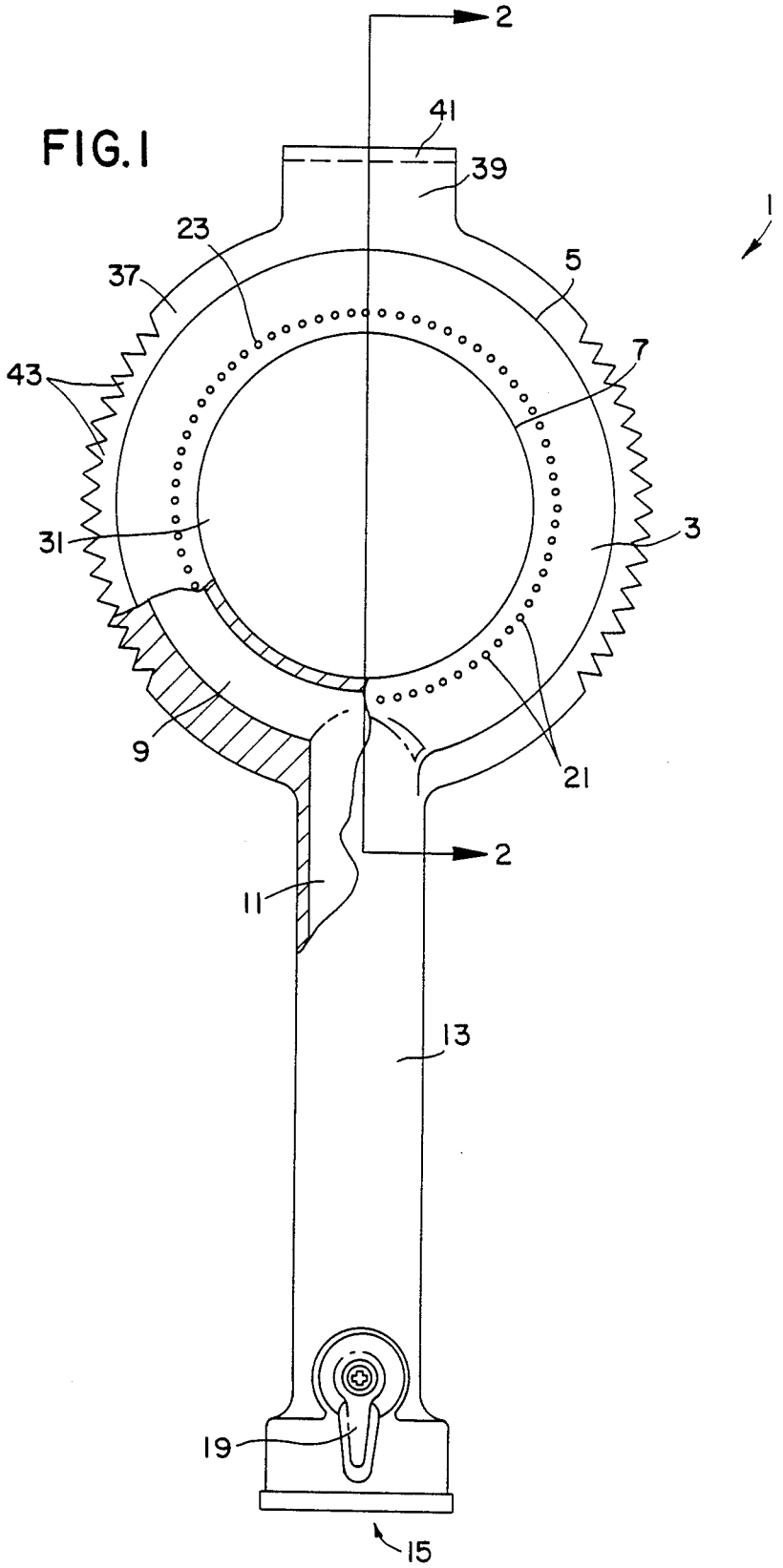
FIG. 1 of the drawings is a bottom perspective view of the apparatus in accordance with this invention showing the overall arrangement of the parts of the device, and includes a sectional view of the annular and longitudinal sleeves showing the liquid passage means connecting with the liquid entry means.
Figure 2:
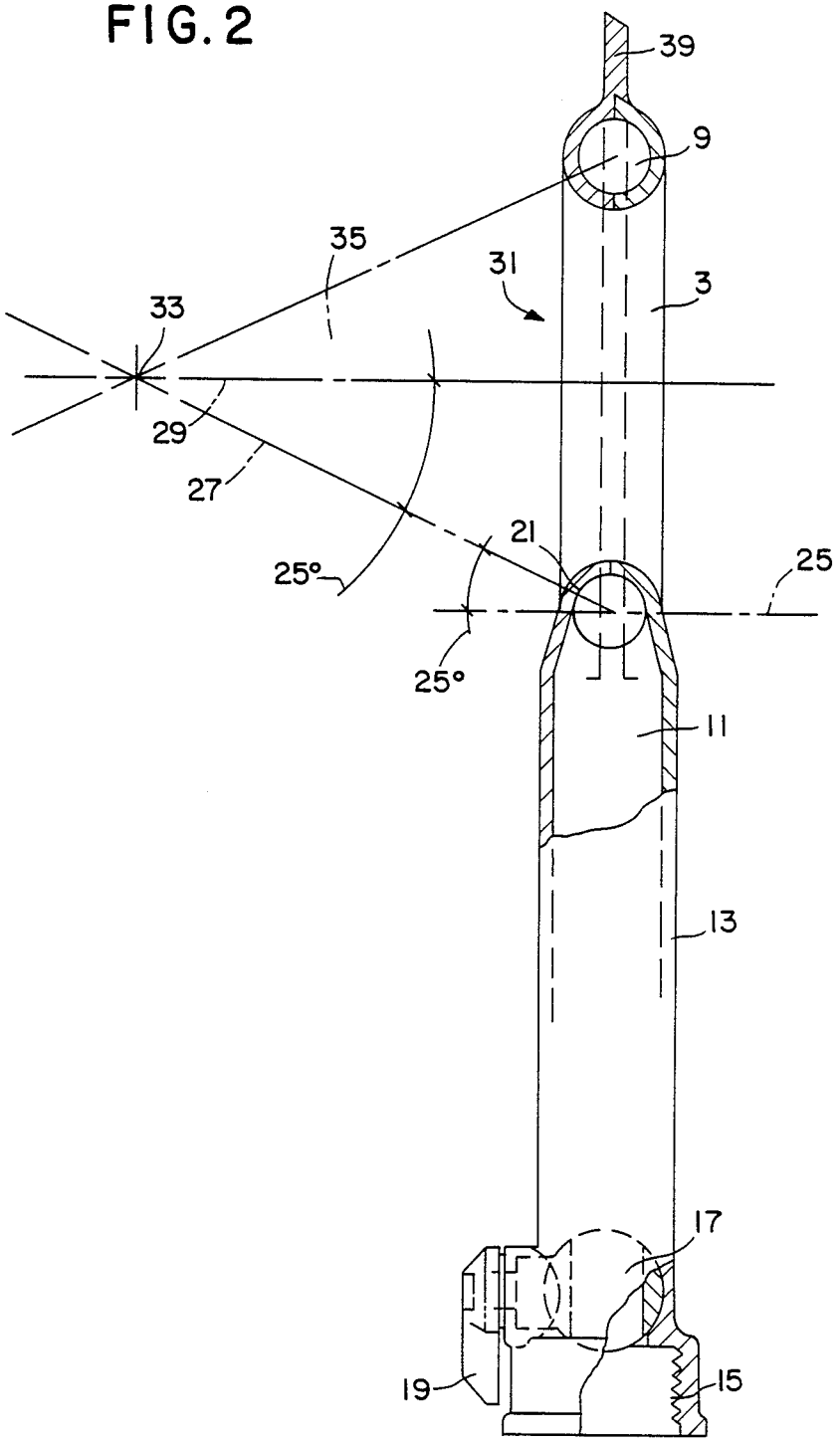
FIG. 2 of the drawings is a side perspective view of the handle of the apparatus in accordance with this invention, including a sectional view of the entire device, and further including a cross-sectional view of the annular sleeve about the line 2—2 of FIG. 1.

FIG. 1 of the drawings illustrates the apparatus of the invention 1, including annular sleeve 3 having an outer surface 5 and an inner surface 7 and defining liquid passage means 9 between the inner and outer surfaces of annular sleeve 3. Liquid passage means 9 communicates with liquid entry means 11, which is housed in longitudinal sleeve 13. The longitudinal sleeve 13 includes a threaded connection 15, as shown in FIG. 2 for accepting a conventional hose fitting (not shown) for purposes of connecting liquid passage means 9, via liquid entry means 11, with a source of liquid under pressure. The longitudinal sleeve 13 further includes a conventional ball valve 17 with associated lever 19 for regulating the flow of pressurized liquid.

Also communicating with liquid passage means 9 is liquid outlet means 21, comprising a plurality of ports, also 21, which are arranged in a circular configuration 23 about the inner surface 7 of annular sleeve 3 at a specified angle of disposition. This angle of disposition of ports 21 is best understood with reference to FIG. 2 of the drawings.

With respect to the orientation of the apparatus of this invention as illustrated in FIG. 2 of the drawings, the horizontal certerline 25 of a cross-section of annular sleeve 3 coincident with a port 21 is the reference line for the specified angle of disposition of the port 21. At each pertinent position along circular configuration 23, a port 21 is disposed at a specified angle, typically approximately 25 degrees, with respect to the centerline 25 of its respective cross-section. It is seen that the angle formed in this way is equal to the angle formed by the intersection of a line 27 extended through each port 21 and line 29 through the center of annular space 31 defined by annular sleeve 3. Thus, conversion point 33 is defined and, together with the plurality of lines 27 through ports 21, an inverted conical zone 35 is defined, which becomes the zone of optimal cleaning and minimal splashing. It is by positioning the paint brush or roller to be cleaned within this zone, and, after connecting the cleaning device to a source of liquid under pressure and setting it in operation, moving the cleaning device principally along the axes of the brush or roller that optimal cleaning results. The jet streams exiting through ports 21 manipulate brush bristles and roller mat by lifting and separating, causing a scrubbing action which forces liquid to penetrate the matrial deeply and agitate the material completely. This scrubbing action flushes paint and tends to loosen dried deposits to provide a clean and re-usable brush or roller.

In addition, external flange 37 along outer surface 5 of annular sleeve 3 provides blade 39 with angled forward edge 41 and notches 43 to scrape and loosen dried paint and other deposits from brushes or rollers which may not have been adequately cleaned at previous times of use.

It is thus seen that the cleaning device described herein provides a novel and effective apparatus and process for cleaning paint brushes and rollers. Further, the device of this invention is made of readily available light-weight materials, is easily manipulated and allows its user to conveniently monitor the cleaning process. As variations of the device of the instant invention will be apparent to one of skill in the art from a reading of the above specifications, such variations are within the spirit and scope of this invention as defined by the following appended claims:

That which is claimed:

1. A cleaning device for paint brushes and rollers comprising:

an annular sleeve open in the center thereof with unrestricted access through said open center, said annular sleeve having an outer surface and an inner surface, defining an annular liquid passage means within said sleeve between said inner and outer surfaces;

a longitudinal sleeve defining an unperforated liquid entry means communicating with said liquid passage means, said longitudinal sleeve including a threaded connection for accepting a conventional hose fitting for purposes of connecting said liquid passage means with a source of liquid under pressure;

liquid outlet means disposed in a circle about said inner surface of said annular sleeve and communicating with said liquid passage means wherein said liquid outlet means comprises a plurality of ports each disposed at an angle with respect to an axial centerline (29) of said annular sleeve to point outward from said annular sleeve; and an external flange disposed circumferentially around the outer surface of said annular sleeve and projecting perpendicularly to said axial centerline of said annular sleeve, including means for scraping and loosening paint or other deposits from said paint brushes and rollers.

2. The cleaning device for paint brushes and rollers in accordance with claim 1 wherein said liquid under pressure exits from said outlet means disposed at an angle with respect to an axial centerline of said annular sleeve forming jet streams which converge at a point on said axial centerline of said annular sleeve outward from said annular sleeve.

3. A cleaning device for paint brushes and rollers in accordance with claim 1 wherein said angle is approximately about 25 degrees.

4. A cleaning device for paint brushes and rollers comprising:

an annular sleeve open in the center thereof with unrestricted access through said open center, said annular sleeve having an outer surface and an inner surface, defining an annular liquid passage means within said sleeve between said inner sleeve and outer sleeve;

a longitudinal sleeve defining an unperforated liquid entry means communicating with said liquid passage means, said longitudinal sleeve including a threaded connection for accepting a conventional hose fitting for purposes of connecting said liquid passage means with a source of liquid under pressure;

liquid outlet means disposed in a circle about said inner surface of said annular sleeve and communicating with said liquid passage means, said liquid outlet means comprising a plurality of ports each disposed at an angle with respect to an axial centerline (29) of said annular sleeve to point outward from said annular sleeve; and an external flange disposed circumferentially around the outer surface of said annular sleeve and projecting perpendicularly to said axial centerline of said annular sleeve having a blade thereon positioned directly opposite said longitudinal sleeve, said blade having an angled forward edge, and notches positioned along said flange between said blade and said sleeve.

* * * * *